US010304381B2

(12) United States Patent
Han

(10) Patent No.: US 10,304,381 B2
(45) Date of Patent: May 28, 2019

(54) PIXEL COMPENSATION CIRCUITS, DRIVING DEVICES, AND DISPLAY DEVICES

(71) Applicant: Shenzhen China Star Optoelectronics Technology Co., Ltd., Shenzhen, Guangdong (CN)

(72) Inventor: Baixiang Han, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 65 days.

(21) Appl. No.: 15/524,264

(22) PCT Filed: Apr. 6, 2017

(86) PCT No.: PCT/CN2017/079557
§ 371 (c)(1),
(2) Date: May 3, 2017

(87) PCT Pub. No.: WO2018/157443
PCT Pub. Date: Sep. 7, 2018

(65) Prior Publication Data

US 2018/0301085 A1 Oct. 18, 2018

(30) Foreign Application Priority Data

Mar. 2, 2017 (CN) ..... 2017 1 0121081

(51) Int. Cl.
*G09G 3/30* (2006.01)
*G09G 3/3233* (2016.01)
(Continued)

(52) U.S. Cl.
CPC ..... *G09G 3/3233* (2013.01); *G09G 3/3208* (2013.01); *G09G 3/3266* (2013.01);
(Continued)

(58) Field of Classification Search
CPC ..... G09G 2300/043; G09G 2320/02; G09G 2320/0204; G09G 2320/045;
(Continued)

(56) References Cited

U.S. PATENT DOCUMENTS

2009/0251452 A1 10/2009 Kang et al.
2014/0152191 A1* 6/2014 Yang ..... G09G 3/3233 315/240
(Continued)

FOREIGN PATENT DOCUMENTS

CN 103544917 A 1/2014
CN 104616621 A 5/2015
(Continued)

*Primary Examiner* — Jennifer T Nguyen
(74) *Attorney, Agent, or Firm* — Andrew C. Cheng

(57) ABSTRACT

The present disclosure relates to a pixel compensation circuit and a driving method thereof, and a display device. The pixel compensation circuit includes a light emitting component, a driving transistor, a first transistor, a second transistor, a third transistor, a fourth transistor, a fifth transistor, and a storage capacitor. One end of the light emitting component connects to the common voltage (VSS). One end of the driving transistor connects to the power voltage (VDD). A control end of the first transistor (T1) connects to first scanning signals (Scan). A control end of the second transistor (T2) connects to the first scanning signals (Scan). A control end of the third transistor (T3) connects to the first scanning signals (Scan). A control end of the fourth transistor (T4) connects to second scanning signals (Scan2). A control end of the fifth transistor (T5) connects to the first scanning signals (Scan).

11 Claims, 4 Drawing Sheets

(51) Int. Cl.
*G09G 3/3266* (2016.01)
*G09G 3/3275* (2016.01)
*G09G 3/3208* (2016.01)

(52) U.S. Cl.
CPC ... *G09G 3/3275* (2013.01); *G09G 2320/0233* (2013.01); *G09G 2330/02* (2013.01)

(58) Field of Classification Search
CPC .. G09G 3/3208; G09G 3/3225; G09G 3/3233; G09G 3/3241; G09G 3/3258
USPC ..... 345/76–82
See application file for complete search history.

(56) References Cited

U.S. PATENT DOCUMENTS

| | | | | |
|---|---|---|---|---|
| 2015/0187266 | A1 | 7/2015 | Qian et al. | |
| 2015/0206474 | A1 | 7/2015 | Akimoto | |
| 2016/0365032 | A1 | 12/2016 | Wu et al. | |
| 2017/0039942 | A1 | 2/2017 | Han | |
| 2018/0226018 | A1* | 8/2018 | Han | G09G 3/3225 |
| 2018/0233080 | A1* | 8/2018 | Chen | G09G 3/3233 |

FOREIGN PATENT DOCUMENTS

| | | | |
|---|---|---|---|
| CN | 104715723 | A | 6/2015 |
| CN | 105590579 | A | 5/2016 |
| CN | 105632404 | A | 6/2016 |
| CN | 106297662 | A | 1/2017 |

* cited by examiner

PIXEL COMPENSATION CIRCUITS, DRIVING DEVICES, AND DISPLAY DEVICES

BACKGROUND OF THE INVENTION

1. Field of the Invention

The present disclosure relates to liquid crystal display technology, and more particularly to a pixel compensation circuit, a driving method, and a display device.

2. Discussion of the Related Art

Organic light-emitting diode (OLED) is accomplished by driving the current passing through the diodes by driving thin film transistors (TFTs). During the operations, the driving TFT may be affected by radiation and the voltage of the source/drain, and the threshold voltage may drift, such that the current passing through the diodes may be affected, which results in non-uniform display performance.

To overcome the above issue, an additional compensation circuit has to be configured with respect to each of the pixels. In this way, the parameters, such as the threshold voltage and the mobility rate, of the driving TFTs of each of the pixels may be compensated, and thus the output current is not relevant to the parameters.

SUMMARY

The present disclosure relates to a pixel compensation circuit, a driving method, and a display device for reducing the impact toward the driving current of the light-emitting component caused by the threshold voltage of the driving TFTs.

In one aspect, a display device includes: a display panel having: a plurality of pixel cells, each of the pixel cells comprising at least one pixel compensation circuit; a common voltage source configured to provide a common voltage (VSS) for the pixel compensation circuit; a power source configured to provide a power voltage (VDD) to the pixel compensation circuit; a scanning driving circuit configured to provide scanning signals to the pixel compensation circuit; a data driving circuit configured to provide data signals to the pixel compensation circuit; wherein the pixel compensation circuit includes: a light emitting component, and one end of the light emitting component connects to the common voltage (VSS); a driving transistor, and one end of the driving transistor connects to the power voltage (VDD) for driving the light emitting component to emit lights; a first transistor, a control end of the first transistor connects to first scanning signals (Scan), a first end of the first transistor connects to data signals, and a second end of the first transistor connects to a control end of the driving transistor; a second transistor, a control end of the second transistor connects to the first scanning signals (Scan), and a first end of the second transistor connects to reference signals; a third transistor, a control end of the third transistor connects to the first scanning signals (Scan), a first end of the third transistor connects to the control end of the driving transistor, and a second end of the third transistor connects to the second end of the second transistor; a fourth transistor, a control end of the fourth transistor connects to second scanning signals (Scan2), and a first end of the fourth transistor connects to a detection voltage; a fifth transistor, a control end of the fifth transistor connects to the first scanning signals (Scan), a first end of the fifth transistor connects to the second end of the driving transistor, and a second end of the fifth transistor connects to the light emitting component; a storage capacitor, a first end of the storage capacitor connects to the second end of the third transistor, and a second end of the storage capacitor connects to the second end of the driving transistor; the first transistor, the second transistor, the third transistor, the fourth transistor, the fifth transistor, and the driving transistor are thin film field effect transistors (FETs); and the light emitting component is an organic light-emitting diode (OLED).

Wherein the first transistor, the second transistor, and the third transistor are transistors of a first type, and the fourth transistor and the fifth transistor are transistors of a second type.

Wherein the first transistor, the second transistor, and the third transistor are N-type thin film FETs, and the fourth transistor and the fifth transistor are P-type thin film FETS.

In another aspect, a pixel compensation circuit includes: a light emitting component, and one end of the light emitting component connects to the common voltage (VSS); a driving transistor, and one end of the driving transistor connects to the power voltage (VDD) for driving the light emitting component to emit lights; a first transistor, a control end of the first transistor connects to first scanning signals (Scan), a first end of the first transistor connects to data signals, and a second end of the first transistor connects to a control end of the driving transistor; a second transistor, a control end of the second transistor connects to the first scanning signals (Scan), and a first end of the second transistor connects to reference signals; a third transistor, a control end of the third transistor connects to the first scanning signals (Scan), a first end of the third transistor connects to the control end of the driving transistor, and a second end of the third transistor connects to the second end of the second transistor; a fourth transistor, a control end of the fourth transistor connects to second scanning signals (Scan2), and a first end of the fourth transistor connects to a detection voltage; a fifth transistor, a control end of the fifth transistor connects to the first scanning signals (Scan), a first end of the fifth transistor connects to the second end of the driving transistor, and a second end of the fifth transistor connects to the light emitting component; a storage capacitor, a first end of the storage capacitor connects to the second end of the third transistor, and a second end of the storage capacitor connects to the second end of the driving transistor.

Wherein the first transistor, the second transistor, the third transistor, the fourth transistor, the fifth transistor, and the driving transistor are thin film field effect transistors (FETs).

Wherein the first transistor, the second transistor, and the third transistor are transistors of a first type, and the fourth transistor and the fifth transistor are transistors of a second type.

Wherein the first transistor, the second transistor, and the third transistor are N-type thin film FETs, and the fourth transistor and the fifth transistor are P-type thin film FETS.

Wherein the light emitting component is an organic light-emitting diode (OLED).

Wherein a voltage of the common voltage is greater than the voltage of the power voltage.

In another aspect, a driving method for the pixel compensation circuit as claimed in claim 4, the method having: in a first phase, the first transistor, the second transistor, and the fourth transistor are turned on, the third transistor and the fifth transistor are turned off, reference signals are written to a first end of a storage capacitor, a detection voltage is written to a second end of the storage capacitor, data signals are written to a control end of the driving transistor, and the control end and the second end of the driving transistor are connected; in a second phase, the first transistor and the second transistor are turned on, the third transistor, the fourth transistor, and the fifth transistor are turned off, the control end and the second end of the driving transistor are connected, and a power voltage (VDD) charges the second end of the storage capacitor via the driving transistor; in a third phase, the third transistor and the fifth transistor are turned on, the first transistor, the second transistor, and the fourth transistor are turned off, a potential of the first end of the storage capacitor and a potential of the second end of the driving transistor jumps equally, the control end and the second end of the driving transistor are connected to drive the light emitting component to emit lights.

Wherein when first scanning signals (Scan) are at the high potential, the first transistor and the second transistor are turned on, and the third transistor the fifth transistor are turned off, and when the first scanning signals (Scan) are at the low potential, the first transistor and the second transistor are turned off, and the third transistor and the fifth transistor are turned on; when the second scanning signals (Scan2) are at the high potential, the fourth transistor is turned on, and when the second scanning signals (Scan2) are at the low potential, the fourth transistor is turned off.

In view of the above, the impact caused by the threshold voltage ($V_{th}$) to the driving current of the light emitting component 11 may be eliminated by the pixel compensation circuit, and thus the non-uniform brightness issue caused by the threshold voltage ($V_{th}$) may be effectively solved.

DETAILED DESCRIPTION OF THE EMBODIMENTS

Embodiments of the invention will now be described more fully hereinafter with reference to the accompanying drawings, in which embodiments of the invention are shown.

Figure 1:
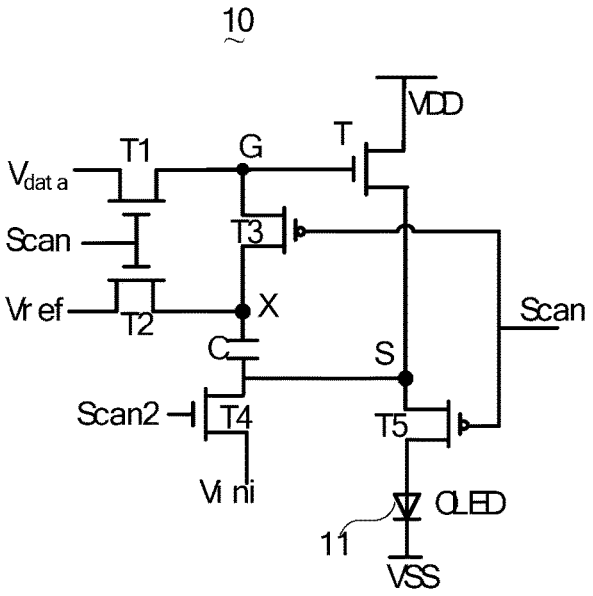
FIG. 1 is a schematic view of the pixel compensation circuit in accordance with one embodiment of the present disclosure.

FIG. 1 is a schematic view of the pixel compensation circuit in accordance with one embodiment of the present disclosure. As shown in FIG. 1, a pixel compensation circuit 10 includes a light emitting component 11, a driving transistor (T), a first transistor (T1), a second transistor (T2), a third transistor (T3), a fourth transistor (T4), a fifth transistor (T5), and a storage capacitor (Cst).

The light emitting component 11 is OLED. One end of the light emitting component 11 connects to a common voltage (VSS), and the common voltage (VSS) is a grounded voltage.

One end of the driving transistor (T) connects to the a power voltage (VDD) for driving the light emitting component 11 to emit lights. A value of the power voltage (VDD) id greater than the value of the common voltage (VSS).

A control end of the first transistor (T1) connects to first scanning signals (Scan), a first end of the first transistor (T1) connects to data signals ($V_{data}$), and a second end of the first transistor (T1) connects to a control end of the driving transistor (T). The second end of the first transistor (T1) and the control end of the driving transistor (T) intersect at a node (G).

A control end of the second transistor (T2) connects to the first scanning signals (Scan), and a first end of the second transistor (T2) connects to reference signals ($V_{ref}$).

A control end of the third transistor (T3) connects to the first scanning signals (Scan), a first end of the third transistor (T3) connects to the control end of the driving transistor (T), and a second end of the third transistor (T3) connects to the second end of the second transistor (T2). The second end of the third transistor (T3) and the second end of the second transistor (T2) intersect at a node (X).

A control end of the fourth transistor (T4) connects to second scanning signals (Scan2), and a first end of the fourth transistor (T4) connects to a detection voltage ($V_{ini}$).

A control end of the fifth transistor (T5) connects to the first scanning signals (Scan), a first end of the fifth transistor (T5) connects to the second end of the driving transistor (T), and a second end of the fifth transistor (T5) connects to the light emitting component 11. The first end of the fifth transistor (T5) and the second end of the driving transistor (T) intersect at a node (S). A second end of the fifth transistor (T5) connects to the light emitting component 11.

A first end of the storage capacitor (Cst) connects to the second end of the third transistor (T3), and a second end of the storage capacitor (Cst) connects to the second end of the driving transistor (T).

The first transistor (T1), the second transistor (T2), the third transistor (T3), the fourth transistor (T4), the fifth transistor (T5), and the driving transistor (T) are thin film field effect transistors (FETs). Specifically, the first transistor (T1), the second transistor (T2), the third transistor (T3) are transistors of a first type, such as N-type thin film FET. The fourth transistor (T4) and the fifth transistor (T5) are transistors of a second type, such as a P-type thin film FET. It can be understood that the first transistor (T1), the second transistor (T2), the third transistor (T3), the fourth transistor (T4), and the fifth transistor (T5) may be electronic components having the switching functions, and thus are not limited to the above. In one embodiment, the first end of the transistor is a drain of the transistor, the second end of the transistor is the source of the transistor. In other embodiments, the source and the drain may be switched, and thus are not limited to the above disclosure.

In one embodiment, a cathode of the light emitting component 11 connects to the common voltage (VSS), and an anode of the light emitting component 11 connects to the second end of the fifth transistor (T5). When the first scanning signals (Scan) controls the fifth transistor (T5) and the driving transistor (T) to turn on, the light emitting component 11, the fifth transistor (T5), and the driving transistor (T) are serially connected. At this moment, the current passing through the light emitting component 11 may be defined by, $I_{OLED}=K(V_{GS}-V_{th})^2$, wherein $K=W/L\times C\times u$, W represents a trench width of the driving transistor (T), L represents a trench length of the driving transistor (T), C represents an intrinsic capacitance between a trench and the control end of the driving transistor (T), and u represents a carrier mobility rate within the trench of the driving transistor (T). According to the above equation, the voltage between the control end and the second end of the driving transistor (T) has to be controlled such that the current passing through the light emitting component 11 may be irrelevant to the threshold voltage ($V_{th}$) of the driving transistor (T). As such, the current passing through the light emitting component 11 may be adjusted.

Figure 2:
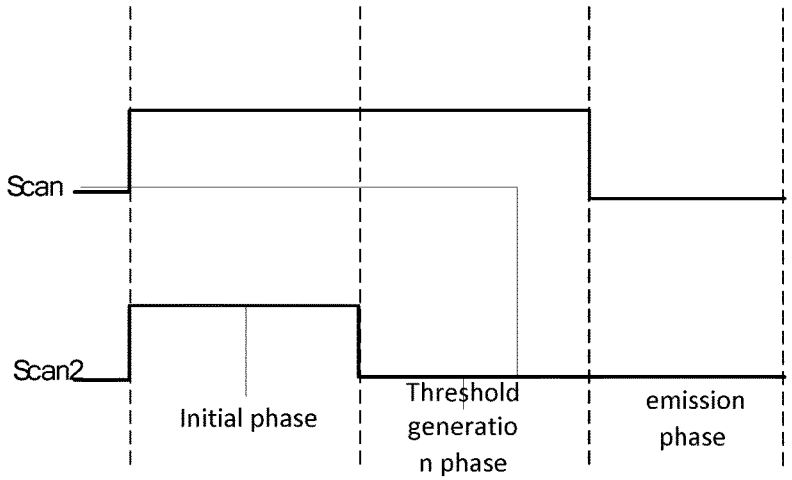
FIG. 2 is a waveform diagram of the pixel compensation circuit in accordance with one embodiment of the present disclosure.

FIG. 2 is a waveform diagram of the pixel compensation circuit in accordance with one embodiment of the present disclosure. The internal compensation phase may include an initial phase, a threshold generation phase, and an emission phase, and the phases will be described in detail hereinafter.

Figure 3:
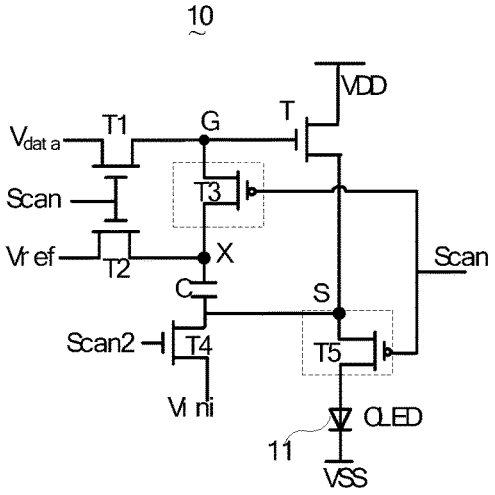
FIG. 3 is a schematic view of the current in an initial phase of the current passing through the pixel compensation circuit in FIG. 1.

FIG. 3 is a schematic view of the current in an initial phase of the current passing through the pixel compensation circuit in FIG. 1. In the initial phase of the pixel compensation circuit 10, as shown in FIG. 3, the frame indicated by the dashed lines relates to an off state of the transistor. When the first scanning signals (Scan) are at a high potential, the first transistor (T1), and the second transistor (T2) are turned on. Correspondingly, as the third transistor (T3), and the fifth transistor (T5) are of the type different from that of the first transistor (T1) and the second transistor (T2), the third transistor (T3) and the fifth transistor (T5) are in the off state. When the second scanning signals (Scan2) are at the high potential, the fourth transistor (T4) is turned on. At the same time, the data signals ($V_{data}$) charges the node (G) via the first end of the first transistor (T1), and the data signals ($V_{data}$) are written to the potential of the node (G). As the data signals ($V_{data}$) are also written to the control end of the driving transistor (T), the control end and the second end of the driving transistor (T) are also turned on. The reference signals ($V_{ref}$) charges the storage capacitor (Cst) via the second transistor (T2), that is, the reference signals ($V_{ref}$) are written to the node (X). the detection voltage ($V_{ini}$) charges the second end of the storage capacitor (Cst) via the fourth transistor (T4), and the detection voltage ($V_{ini}$), i.e., the low potential, is written to the node (S).

Figure 4:
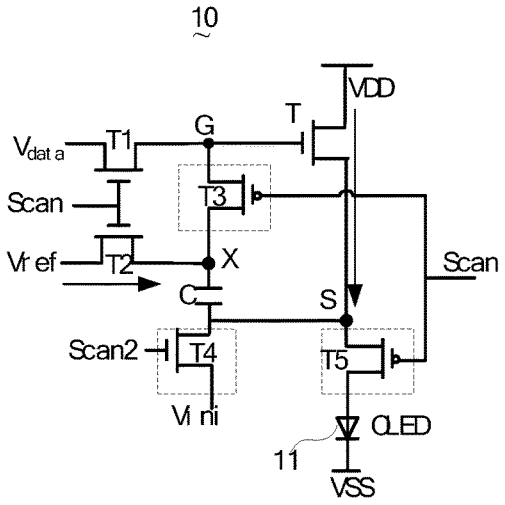
FIG. 4 is a schematic view of the current in a threshold generation phase of the current passing through the pixel compensation circuit in FIG. 1.

FIG. 4 is a schematic view of the current in a threshold generation phase of the current passing through the pixel compensation circuit in FIG. 1. In the $V_{th}$ generation phase of the pixel compensation circuit 10, the frame indicated by the dashed lines relates to the off state of the transistor. When the first scanning signals (Scan) remain at the high potential, the first transistor (T1) and the second transistor (T2) remain in the on state, the third transistor (T3) and the fifth transistor (T5) remain in the off state, and the driving transistor (T) remains in the on state. The potential of the node (G) is the same with that of the data signals ($V_{data}$), and the potential of the node (X) is the same with that of the reference signals ($V_{ref}$). When the second scanning signals (Scan2) are at the low potential, the fourth transistor (T4) is controlled to be turned off. At this moment, the second end of the storage capacitor (Cst) is in a floating state, i.e., the potential of the node (S) is also in the floating state. The voltages of the control end and the first end of the driving transistor (T) are constant. The power voltage (VDD) charges the node (S) via the driving transistor (T). The potential of the node (S) is raised up to "$V_{data}-V_{th}$", i.e., the threshold voltage ($V_{th}$) of the driving transistor (T) is captured to the node (S). When the charging process completes, the driving transistor (T) is turned off, and a voltage difference at two ends of the storage capacitor (Cst) is $V_{ref}-(V_{data}-V_{th})$, and the storage capacitor (Cst) stores the voltage difference, i.e., $V_{ref}-(V_{data}-V_{th})$.

Figure 5:
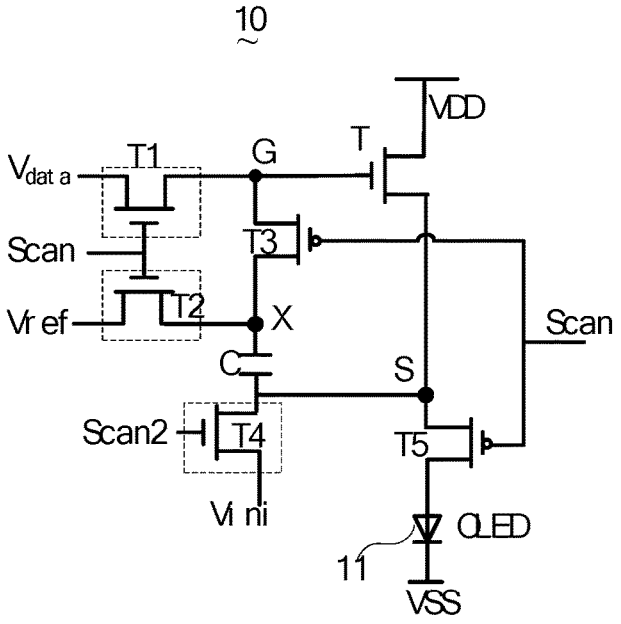
FIG. 5 is a schematic view of the current in an emitting phase of the current passing through the pixel compensation circuit in FIG. 1.

FIG. 5 is a schematic view of the current in an emitting phase of the current passing through the pixel compensation circuit in FIG. 1. In the emission phase of the pixel compensation circuit 10, the frame indicated by the dashed lines relates to the off state of the transistor. In the emission phase, the first scanning signals (Scan) are at the low potential, and thus the first transistor (T1) and the second transistor (T2) are in the off state. Correspondingly, the third transistor (T3) and the fifth transistor (T5) are in the on state. The second scanning signals (Scan2) are at the low potential, and the fourth transistor (T4) are in the off state. The node (G) remains at the potential of the data signals ($V_{data}$) of the previous phase, the voltage difference between the control end and the second end of the driving transistor (T) is greater than the threshold voltage ($V_{th}$), and the driving transistor (T) is turned on. In addition, the third transistor (T3) is turned on, the potential of the node (X) jumps, that is, the node (G) charges the node (X) via the third transistor (T3) such that the potential of the first end of the storage capacitor (Cst) jumps from the reference signals ($V_{ref}$) to the data signals ($V_{data}$). Regardless of the coupling capacitance of the light emitting component 11, the potential of the node (S), i.e., the potential of the second end of the storage capacitor (Cst), jumps according to the equation: $V_S=V_{data}-V_{th}+(V_{data}-V_{ref})$. At this moment, the voltage difference between two ends of the storage capacitor (Cst) is: $V_{GS}=V_{ref}-(V_{data}-V_{th})$ i.e., the potential of the previous phase. The driving transistor (T), the fifth transistor (T5), and the light emitting component 11 are serially connected. The light emitting component 11 emits lights, and the current passing through the light emitting component 11 in the emission phase is defined as: $I_{OLED}=K*(V_{GS}-V_{th})^2=K*(V_{ref}-V_{data})^2$. It may be concluded that the current passing through the light emitting component 11, i.e., $I_{OLED}$, is relevant to the data signals ($V_{data}$) and the reference signals ($V_{ref}$), and is irrelevant to the threshold voltage ($V_{th}$) of the driving transistor (T) and the current ($V_{OLED}$) passing through the light emitting component 11. Thus, the impact caused by the threshold voltage ($V_{th}$) of the driving transistor (T) to the current ($V_{OLED}$) passing through the light emitting component 11 is eliminated.

In addition, a driving method of the pixel compensation circuits is disclosed. Referring to FIGS. 1 and 2, one operational period of the pixel compensation circuit 10 may include four phases, including the first phase, the second phase, and the third phase, and the phases respectively corresponds to the initial phase, the generation phase, and the emission phase of the pixel compensation circuit discussed above.

In the first phase, the first transistor (T1), the second transistor (T2), and the fourth transistor (T4) are turned on, the third transistor (T3) and the fifth transistor (T5) are turned off, the reference signals ($V_{ref}$) are written to the first end of the storage capacitor (Cst), the detection voltage ($V_{ini}$) is written to the second end of the storage capacitor (Cst), the data signals ($V_{data}$) are written to the control end of the driving transistor (T), and the control end and the second end of the driving transistor (T) are connected.

In the second phase, the first transistor (T1) and the second transistor (T2) are turned on, the third transistor (T3), the fourth transistor (T4), and the fifth transistor (T5) are turned off, the control end and the second end of the driving transistor (T) are connected, and the power voltage (VDD) charges the second end of the storage capacitor (Cst) via the driving transistor (T).

In the third phase, the third transistor (T3) and the fifth transistor (T5) are turned on, the first transistor (T1), the second transistor (T2), and the fourth transistor (T4) are turned off, the potential of the first end of the storage capacitor (Cst) and the potential of the second end of the driving transistor (T) jumps equally, the control end and the second end of the driving transistor (T) are connected to drive the light emitting component 11 to emit lights.

In the embodiment, the first transistor (T1), the second transistor (T2), the third transistor (T3), the fourth transistor (T4), and the fifth transistor (T5) are controlled by the potential of the first scanning signals (Scan) and the first scanning signals (Scan) so as to be turned on or off.

Specifically, when the first scanning signals (Scan) are at the high potential, the first transistor (T1) and the second transistor (T2) are turned on, and the third transistor (T3) the fifth transistor (T5) are turned off. When the first scanning signals (Scan) are at the low potential, the first transistor (T1) and the second transistor (T2) are turned off, and the third transistor (T3) and the fifth transistor (T5) are turned on.

When the second scanning signals (Scan2) are at the high potential, the fourth transistor (T4) is turned on. When the second scanning signals (Scan2) are at the low potential, the fourth transistor (T4) is turned off.

In view of the above, the impact caused by the threshold voltage ($V_{th}$) to the driving current of the light emitting component 11 may be eliminated by the pixel compensation circuit, and thus the non-uniform brightness issue caused by the threshold voltage ($V_{th}$) may be effectively solved.

Figure 6:
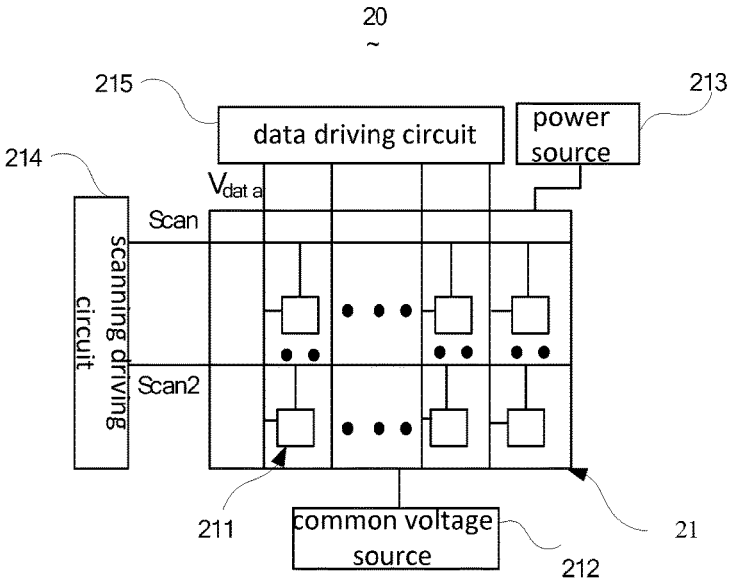
FIG. 6 is a schematic view of the display device in accordance with one embodiment of the present disclosure.

FIG. 6 is a schematic view of the display device in accordance with one embodiment of the present disclosure. As shown in FIG. 6, the display device 20 may include a display panel 21 having a plurality of pixel cells 211, a common voltage source 212, a power source 213, a scanning driving circuit 214, and a data driving circuit 215.

Each of the pixel cells 211 includes any one of the above pixel compensation circuit.

The common voltage source 212 is configured to provide a common voltage (VSS) for the pixel compensation circuit.

The power source 213 is configured for providing the power voltage (VDD) to the pixel compensation circuit.

The scanning driving circuit 214 is configured to provide the scanning signals to the pixel compensation circuit, and the scanning signals may include the first scanning signals (Scan) and the second scanning signals (Scan2).

The data driving circuit 215 is configured to provide the data signals to the pixel compensation circuit, and the data signals may include the data signals ($V_{data}$) and the reference signals ($V_{ref}$).

It can be understood that the pixel compensation circuit may be any one of the above pixel compensation circuits, and the structure and the operations of the pixel compensation circuit may be referenced above.

In view of the above, the impact caused by the threshold voltage ($V_{th}$) to the driving current of the light emitting component 11 may be eliminated by the pixel compensation circuit, and thus the non-uniform brightness issue caused by the threshold voltage ($V_{th}$) may be effectively solved.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A display device, comprising:

a display panel comprising:

a plurality of pixel cells, each of the pixel cells comprising at least one pixel compensation circuit;

a common voltage source configured to provide a common voltage (VSS) for the pixel compensation circuit;

a power source configured to provide a power voltage (VDD) to the pixel compensation circuit;

a scanning driving circuit configured to provide scanning signals to the pixel compensation circuit;

a data driving circuit configured to provide data signals to the pixel compensation circuit;

wherein the pixel compensation circuit comprises:

a light emitting component, and one end of the light emitting component connects to the common voltage (VSS);

a driving transistor, and one end of the driving transistor connects to the power voltage (VDD) for driving the light emitting component to emit lights;

a first transistor, a control end of the first transistor connects to first scanning signals (Scan), a first end of the first transistor connects to data signals, and a second end of the first transistor connects to a control end of the driving transistor;

a second transistor, a control end of the second transistor connects to the first scanning signals (Scan), and a first end of the second transistor connects to reference signals;

a third transistor, a control end of the third transistor connects to the first scanning signals (Scan), a first end of the third transistor connects to the control end of the driving transistor, and a second end of the third transistor connects to the second end of the second transistor;

a fourth transistor, a control end of the fourth transistor connects to second scanning signals (Scan2), and a first end of the fourth transistor connects to a detection voltage;

a fifth transistor, a control end of the fifth transistor connects to the first scanning signals (Scan), a first end of the fifth transistor connects to the second end of the driving transistor, and a second end of the fifth transistor connects to the light emitting component;

a storage capacitor, a first end of the storage capacitor connects to the second end of the third transistor, and a second end of the storage capacitor connects to the second end of the driving transistor;

the first transistor, the second transistor, the third transistor, the fourth transistor, the fifth transistor, and the driving transistor are thin film field effect transistors (FETs); and the light emitting component is an organic light-emitting diode (OLED).

2. The display device as claimed in claim 1, wherein the first transistor, the second transistor, and the third transistor are transistors of a first type, and the fourth transistor and the fifth transistor are transistors of a second type.

3. The display device as claimed in claim 2, wherein the first transistor, the second transistor, and the third transistor are N-type thin film FETs, and the fourth transistor and the fifth transistor are P-type thin film FETS.

4. A pixel compensation circuit, comprising:

a light emitting component, and one end of the light emitting component connects to a common voltage (VSS);

a driving transistor, and one end of the driving transistor connects to a power voltage (VDD) for driving the light emitting component to emit lights;

a first transistor, a control end of the first transistor connects to first scanning signals (Scan), a first end of the first transistor connects to data signals, and a second end of the first transistor connects to a control end of the driving transistor;

a second transistor, a control end of the second transistor connects to the first scanning signals (Scan), and a first end of the second transistor connects to reference signals;

a third transistor, a control end of the third transistor connects to the first scanning signals (Scan), a first end of the third transistor connects to the control end of the driving transistor, and a second end of the third transistor connects to the second end of the second transistor;

a fourth transistor, a control end of the fourth transistor connects to second scanning signals (Scan2), and a first end of the fourth transistor connects to a detection voltage;

a fifth transistor, a control end of the fifth transistor connects to the first scanning signals (Scan), a first end of the fifth transistor connects to the second end of the driving transistor, and a second end of the fifth transistor connects to the light emitting component;

a storage capacitor, a first end of the storage capacitor connects to the second end of the third transistor, and a second end of the storage capacitor connects to the second end of the driving transistor.

5. The pixel compensation circuit as claimed in claim 4, wherein the first transistor, the second transistor, the third transistor, the fourth transistor, the fifth transistor, and the driving transistor are thin film field effect transistors (FETs).

6. The pixel compensation circuit as claimed in claim 5, wherein the first transistor, the second transistor, and the third transistor are transistors of a first type, and the fourth transistor and the fifth transistor are transistors of a second type.

7. The pixel compensation circuit as claimed in claim 6, wherein the first transistor, the second transistor, and the third transistor are N-type thin film FETs, and the fourth transistor and the fifth transistor are P-type thin film FETS.

8. The pixel compensation circuit as claimed in claim 4, wherein the light emitting component is an organic light-emitting diode (OLED).

9. The pixel compensation circuit as claimed in claim 4, wherein a voltage of the common voltage is greater than the voltage of the power voltage.

10. A driving method for the pixel compensation circuit as claimed in claim 4, the method comprising:

in a first phase, the first transistor, the second transistor, and the fourth transistor are turned on, the third transistor and the fifth transistor are turned off, reference signals are written to a first end of the storage capacitor, the detection voltage is written to a second end of the storage capacitor, data signals are written to the control end of the driving transistor, and the control end and the second end of the driving transistor are connected;

in a second phase, the first transistor and the second transistor are turned on, the third transistor, the fourth transistor, and the fifth transistor are turned off, the control end and the second end of the driving transistor are connected, and the power voltage (VDD) charges the second end of the storage capacitor via the driving transistor;

in a third phase, the third transistor and the fifth transistor are turned on, the first transistor, the second transistor, and the fourth transistor are turned off, a potential of the first end of the storage capacitor and a potential of the second end of the driving transistor jumps equally, the control end and the second end of the driving transistor are connected to drive the light emitting component to emit lights.

11. The driving method as claimed in claim 10, wherein when the first scanning signals (Scan) are at the high potential, the first transistor and the second transistor are turned on, and the third transistor and the fifth transistor are turned off, and when the first scanning signals (Scan) are at the low potential, the first transistor and the second transistor are turned off, and the third transistor and the fifth transistor are turned on;

when the second scanning signals (Scan2) are at the high potential, the fourth transistor is turned on, and when the second scanning signals (Scan2) are at the low potential, the fourth transistor is turned off.

* * * * *